United States Patent [19]

Gladow

[11] 4,151,985

[45] May 1, 1979

[54] LONG FOLD SUPPORT STRUCTURE FOR ZIGZAG WEB-FED FOLDER

[75] Inventor: Dean E. Gladow, Emporia, Kans.

[73] Assignee: Didde-Glaser, Inc., Emporia, Kans.

[21] Appl. No.: 789,780

[22] Filed: Apr. 22, 1977

[51] Int. Cl.[2] ..... B65H 45/20

[52] U.S. Cl. ..... 270/79

[58] Field of Search ..... 270/79, 61 F; 93/84 R

[56] References Cited

U.S. PATENT DOCUMENTS

| | | | |
|---|---|---|---|
| 1,203,722 | 11/1916 | Fulk | 270/79 |
| 2,098,427 | 11/1937 | Menschner | 270/79 |
| 3,124,350 | 3/1964 | Huffman | 270/79 |
| 3,547,430 | 12/1970 | Assony | 270/79 |

*Primary Examiner*—Edgar S. Burr
*Assistant Examiner*—A. Heinz
*Attorney, Agent, or Firm*—Schmidt, Johnson, Hovey & Williams

[57] ABSTRACT

An improved spiral-type zigzag web folding unit is provided which includes an inexpensive, replaceable, constant tension recoil spring coupled to the shiftable web feeder chute of the folding unit for individually and successively supporting relatively long web sections as they are fed, in order to prevent excessive gravity-induced sagging thereof and consequent failure of the spirals to engage and receive the fed sections. Use of an oscillating recoil spring permits high-speed folding operations with automatically timed support for the web sections, notwithstanding the fact that the spring requires no adjustment in use and can be easily installed and replaced using readily available materials and tools. Furthermore, coupling of the spring to the feeding chute ensures that the spring does not impede web feeding but rather moves in timed relationship therewith for support purposes. The support spring assembly hereof is also advantageous in that inertia problems are minimized and support is provided along a substantial portion of the web sections in timed relation to the feeding thereof.

4 Claims, 9 Drawing Figures

LONG FOLD SUPPORT STRUCTURE FOR ZIGZAG WEB-FED FOLDER

This invention relates to an improved spiral-type zigzag folding unit especially adapted for zigzag folding of a continuous web perforated to present relatively long, interconnected sections, and includes means for preventing excessive gravity-induced sagging of the web sections during the folding operation. More particularly, it is concerned with such web folding unit which includes web support means in the form of a recoil spring coupled to the feeding mechanism of the folding unit for oscillation therewith and support of the respective web sections as they are fed.

Zigzag web-fed folders are well known to those skilled in the art. Such units are generally used to Z-fold an elongated, continuous web of paper or the like along equidistantly spaced transverse perforation lines in order to present a continuous series of zigzag folded sections. These folders generally include an oscillating feeding chute along with four spaced, strategically located, axially rotatable sheet-receiving spirals. In use, the feeding mechanism is actuated to feed the web as a series of interconnected, opposed web sections, and as the latter are created they are engaged and received by the rotating spirals. The latter serve to collect and fold the web along the previously punched transverse perforation lines, and thereafter deliver the folded web to a receiving conveyor. In some cases, rotating fingers adjacent the spirals are used for creasing the web along the respective perforation lines.

Although conventional zigzag folders of the type described are eminently successful when used to form a folded web having relatively short, interconnected sections, problems can arise when it is attempted to use these machines for creating longer folds. Specifically, as long web sections are fed from the feeding chute, there is a tendency for the sections to sag under the influence of gravity to the extent that the spirals can fail to catch and engage the ends of the sections. As can be appreciated, when this occurs, it is often necessary to completely shut down the overall web-handling apparatus, since a single unengaged fold tends to completely disrupt successive sections and folds.

It is therefore the most important object of the present invention to provide web-folding apparatus especially adapted to handle long web fold sections by provision of means for preventing excessive gravity-induced sagging of the web sections as the latter are fed, so that receipt of the sections by web-receiving means associated with the apparatus is assured.

As a corollary to the foregoing, another object of the invention is to provide a web-folding apparatus having relatively inexpensive, replaceable web-supporting structure coupled to the web-feeding mechanism for automatic timed support of the successive web sections as the latter are fed, in order to prevent excessive web sagging and consequent lack of engagement with the web-receiving means; in preferred forms, the web-supporting structure includes an elongated, unitary recoil spring having the free end thereof coupled to shiftable web-feeding structure for oscillation of the spring with the latter in a manner to ensure unimpeded web-feeding while also providing support along a substantial portion of each of the web sections as the same are fed.

Another object of the invention is to provide a support assembly for preventing excessive gravity-induced sagging of web sections fed from a zigzag folding unit which includes a recoil spring (preferably constant tension), means for coupling the free end of the spring to the web-feeding mechanism, and means for rotatably supporting the coiled section of the spring adjacent the web feeder for successive extension and retraction of the free end of the spring during shifting of the web feeder, in order to cause a stretch of the spring to engage and support at least a portion of each of the web sections as the latter are successively fed.

Figure 9:
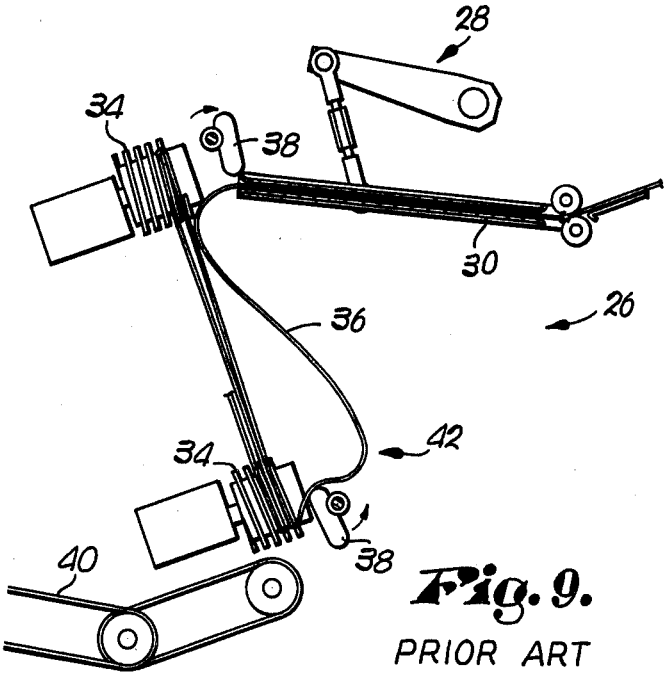
Fig. 9. PRIOR ART
Figure 8:
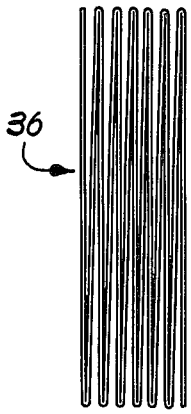

FIG. 8 is a side-elevational view of a plurality of zigzag folded web sections as produced by the apparatus in accordance with the invention; and FIG. 9 is an essentially schematic side-elevational view of conventional zigzag folding apparatus, and illustrating the problems encountered when gravity-induced sag of the web sections causes one of the latter to sag to a point where the associated receiving spirals cannot engage the web section.

Figure 1:
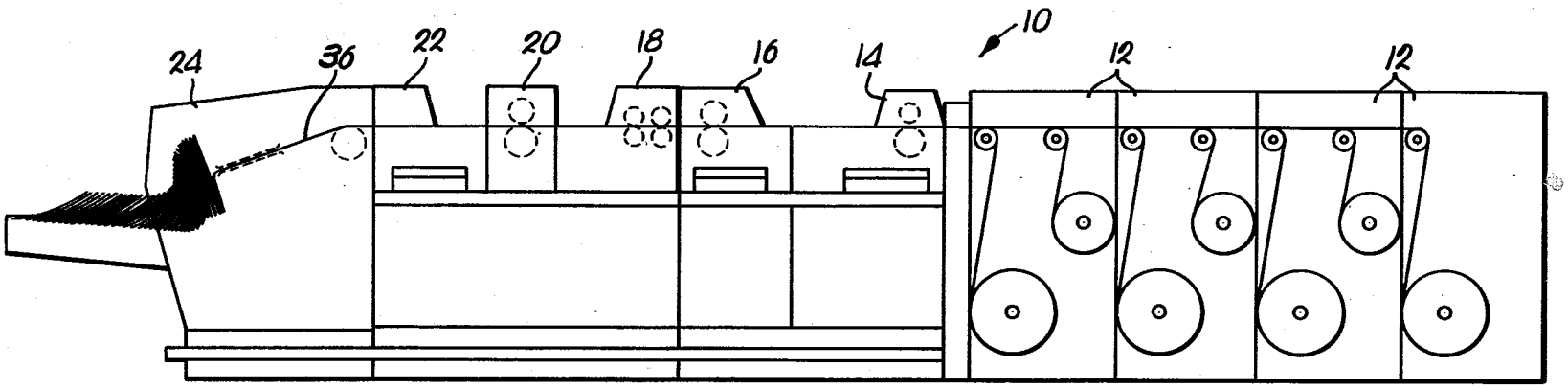
FIG. 1 is an essentially schematic elevational view of a web-fed folding apparatus having a spiral-type zigzag folding mechanism as an adjunct thereof.

Turning now to the drawings, one type of in-line, multiple-station collator 10 is illustrated in FIG. 1. Collator 10 is especially designed to produce a numbered, perforated and marginally punched web which is zigzag-folded into sections. For this purpose, collator 10 includes a plurality of in-line web stations 12, a numbering station 14, a lineal perforation unit 16, a crimping station 18, a cross perforation unit 20, a file hole punch unit 22, and finally a folding station 24. Of course, in other specific types of collators, additional or different types of processing stations can be provided. For example, the folding unit hereof may be used with conventional web presses or as a part of off-line web-handling equipment. In any event, the present invention is principally concerned with provision of an improved folding mechanism which can be used in essentially any type of web-handling apparatus.

Figure 2:
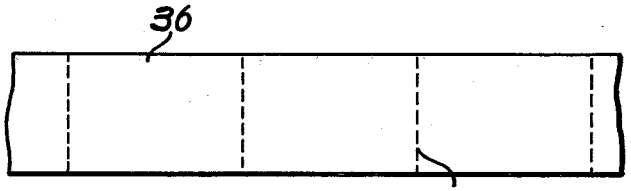
FIG. 2 is a fragmentary plan view of a continuous web of material of the type produced in the folding unit illustrated in FIG. 1 and having a series of longitudinally spaced, transversely extending perforation lines thereacross.

A conventional spiral-type zigzag folding device 26 is depicted in FIG. 9. This unit includes a web-feeding mechanism 28 having a shiftable feeding chute 30 which is oscillated in a generally up-and-down fashion by means of a powered linkage assembly 32. Web-receiving means in the form of four spaced, axially rotatable spiral elements 34 are provided, with the latter being oriented for engaging the margins of a continuous sectionalized web 36 between adjacent fold sections. The latter generally includes a series of longitudinally spaced transverse perforation lines 37 in order to divide the web into sections of a desired length (see FIG. 2). A series of rotatable creasing fingers 38 are also provided for engaging the perforation lines 37 as they are engaged by the spiral elements in order to crease the web along the perforation lines. Finally, a conveyor system 40 is provided adjacent the output ends of the spiral elements for conveying the Z-folded web to a receiving location.

Although folding devices of the type illustrated in FIG. 9 has proven to be highly successful in practice, a serious problem can arise when it is attempted to create relatively long fold sections in the web. Specifically, relatively long web sections (for example, 17-inch) can sag under the influence of gravity as they are fed from chute 30 to an extent that the section will not be engaged and received by the uppermost spiral elements 34. This sagging problem can be further compounded when it is attempted to handle relatively narrow webs, webs having less than three plies, or webs made up of thin sheets. This sagging condition is illustrated in FIG. 9, where it will be seen that an excessive sag as at 42 is created during the upward travel of chute 30 when a section of web 36 is being fed. The sagging of the web section and consequent failure to engage and be received by the upper spiral elements creates serious difficulties in the operation of device 10, and generally means that the entire folding operation must be stopped to correct the problem.

In addition, any proposed solution to the problem of web section sagging must not interfere with or impede smooth, efficient web feeding or reception. Thus, stationary web-supporting devices would in general be troublesome because of the interference these would present to web feeding during oscillation of the web chute.

Figure 3:
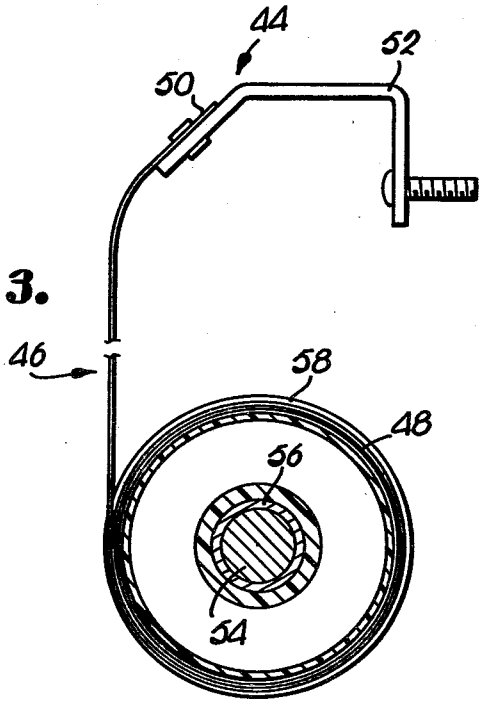
FIG. 3 is a fragmentary view in partial vertical section of the recoil spring web support assembly of the present invention.
Figure 4:
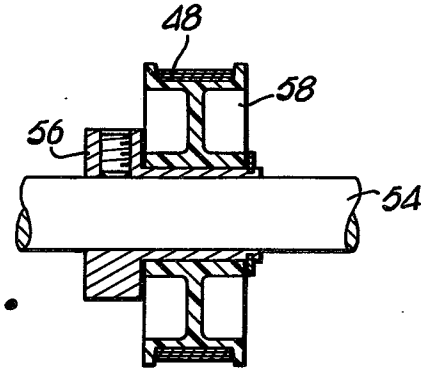
FIG. 4 is a fragmentary vertical sectional view illustrating the support structure provided for the coiled end of the recoil spring in the assembly of FIG. 3.

The present invention provides a complete solution to the problem of gravity-induced web sagging. For this purpose, means are provided for preventing excessive gravity-induced sagging of the web sections as the latter are fed in order to ensure receipt of the respective sections by the web-receiving spirals. In practice, a support assembly 44 (see FIG. 3) is provided as an adjunct to the conventional device 26 for supporting the web sections as the latter are successively fed. Support assembly 44 includes an elongated web section-engaging element in the form of a continuous, unitary, recoil spring 46. In preferred forms a constant tension recoil spring is employed, such as that sold under designation of a "negator" spring. Spring 46 has a coiled portion 48 and a free end 50. Free end 50 is preferably permanently attached to a mounting bracket 52 in order to facilitate installation of assembly 44 on device 26 in a manner to be explained. In addition, assembly 44 includes an elongated mounting shaft 54 having a hub member 56 (see FIG. 4) secured thereto. A spool 58 is rotatably mounted on hub member 56 for allowing rotation of the spool during web-supporting operations.

Figure 5:
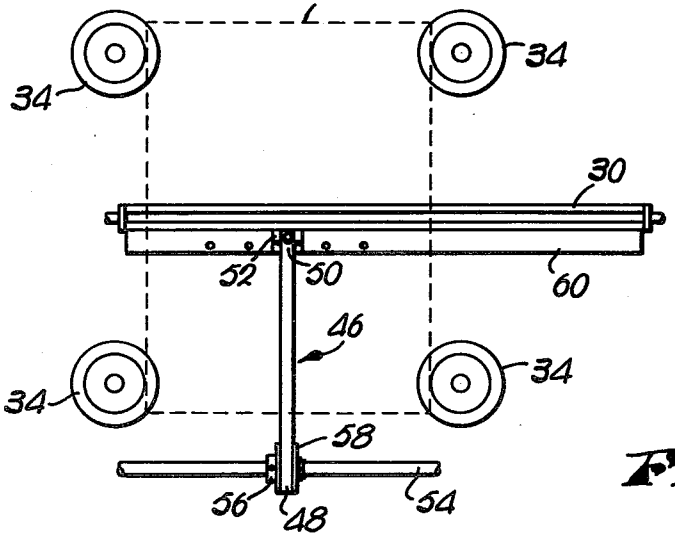
FIG. 5 is a schematic, front elevational view illustrating oscillating web-feeding means, web-receiving spirals, and the support assembly of the present invention coupled to the feeding mechanism, with a single web section being depicted in phantom as it would appear during the folding sequence.

Turning now to FIG. 5, a folding device 26 having support assembly 44 installed thereon is schematically depicted. Free end 50 of negator recoil spring 46 is coupled to feeding chute 30 by means of bracket 52 which mates with a depending, apertured lip 60 provided with the chute 30. In addition, shaft 54 is fixedly mounted within the station 24 below chute 30 so that spring 46 can be successively extended and retracted as chute 30 oscillates. Lip 60 is provided with a series of spaced apertures as shown, while hub 56 and spool 58 are laterally shiftable on shaft 54 to allow selective positioning of spring 46 at the central area of webs of various widths.

Figure 6:
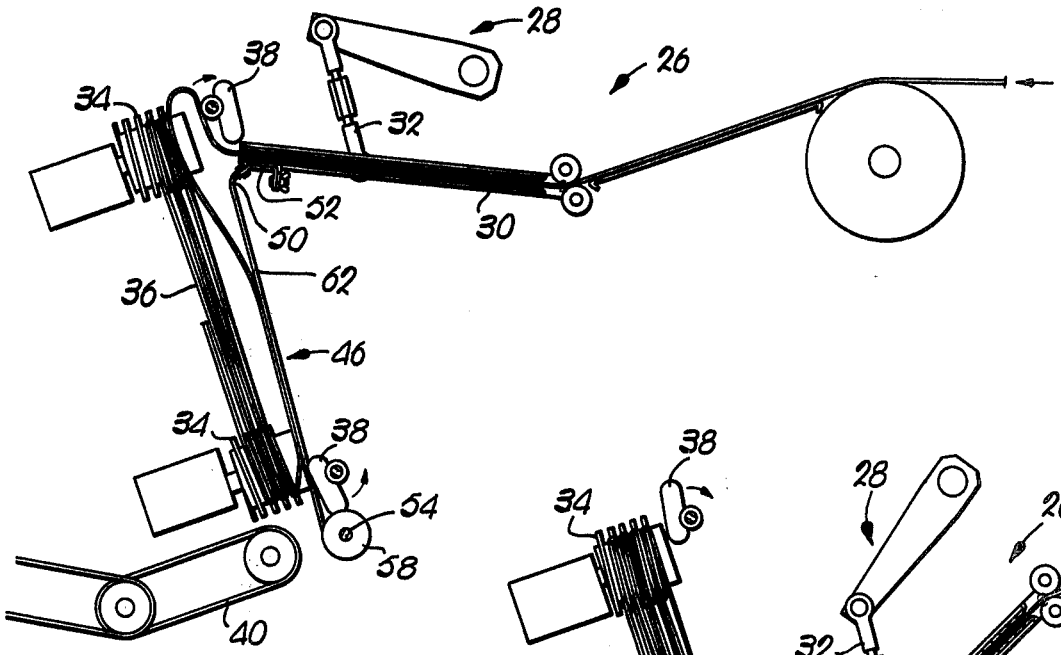
FIGS. 6 and 7 are essentially schematic, side-elevational views of the operation of a zigzag, spiral-type web folder, with the operation of the support assembly of the invention also being depicted.
Figure 7:
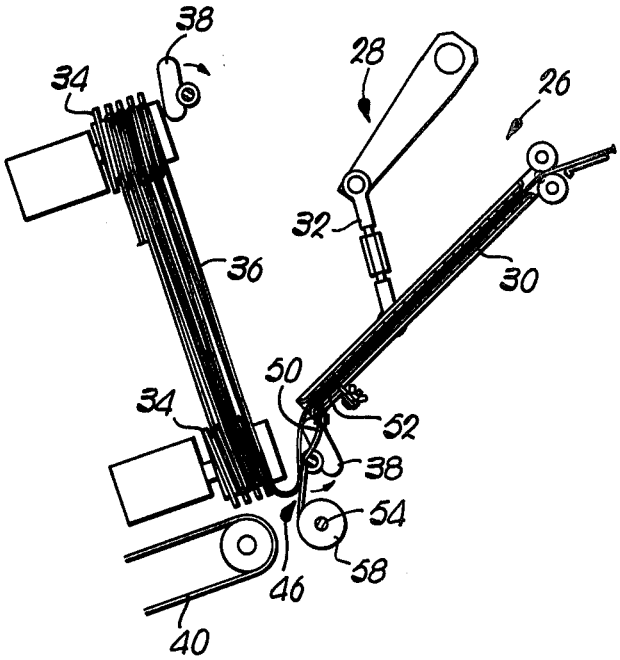

The operation of assembly 44 is illustrated in FIGS. 6 and 7. Referring first to FIG. 7, feeding chute 30 is depicted in its lowest position, with a short stretch of the web 36 extending therefrom. In this orientation, spring 46 is substantially coiled around spool 58 with only a short length thereof extending upwardly from the spool. FIG. 6, on the other hand, illustrates feeding chute 30 in its uppermost position when a full section of the web 36 has been fed. In this orientation, a relatively long stretch 62 of negator spring 46 extends between spool 58 and feeding element 30, and this stretch 62 serves to supportively engage the web section over a substantial portion of the length thereof in order to prevent excessive gravity-induced sag of the section. In this manner, the web section can be engaged and received by the upper spirals 34 in the usual fashion. It will be appreciated from the foregoing that during the operation of assembly 44, spring 46 is successively extended and retracted relative to the spool 58 as feeding chute 30 oscillates. Thus, support for each section of web 36 is provided as the respective sections are fed. Moreover, no interference whatsoever is presented to web feeding or reception, by virtue of the extension-retraction movement of spring 46 and the connection of the free end of the latter to the feeding chute itself. The final result of this operation is to Z-fold web 36 to present a series of opposed, interconnected web sections, as best shown in FIG. 8.

In practice, it has been found that support assembly 44 provides an inexpensive, readily replaceable means for preventing excessive web sag. The preferred constant tension recoil spring 46 generally has a life of at least ten million cycles or approximately two weeks of continuous operation at full machine speed, and permits high-speed folding. Another significant advantage stems from the automatic timing provided through connection of spring 46 to the feeding chute 30. Since the spring 46 oscillates in correspondence with chute 30, the web-engaging stretch 62 is automatically present without the need for separate timing or control. Furthermore, the relatively low mass of the spring 46 avoids inertia problems which could be troublesome if a separate linkage mechanism or the like were employed for supporting the web sections. Finally, it will also be appreciated that when assembly 44 is not needed (as, for example, when relatively short sections are being folded), it is only necessary to disconnect bracket 52 from lip 60, whereupon chute 30 will oscillate in the normal fashion without successive extension and retraction of the negator spring 46. Thus, it is a simple matter to install and use assembly 44 as needed.

Having thus described the invention, what is claimed as new and desired to be secured by Letters Patent is:

1. In a unit for folding an elongated web in zigzag fashion which includes upper and lower pairs respectively of horizontally spaced, rotatable, web-receiving spirals that are oriented to receive stretches of the web therebetween in serpentine defining, upright disposition, and wherein is provided an oscillating web feeder for the spirals having a feed end movable back and forth between the upper and lower pairs of spirals respectively for feeding marginal portions of the web into first one pair of spirals and then the other to effect zigzag folding of the web, the combination of:

means defining a fixed mount adjacent the end of the path of travel of said feed end of the web feeder proximal to the lower pair of spirals as the feeder moves between the upper and lower pairs of spirals; and web support structure including extensible and retractable means having an element connected to the mount and said web feeder respectively and which winds up to a retracted condition as the web feeder shifts toward the lower pair of spirals but unwinds and extends as the web feeder moves toward the upper pair of spirals, said element being positioned as it extends to provide an upright web supporting surface of increasing height which is operable to engage and prevent sagging of the stretch of the web first received from the feeder in the lower spirals until such stretch is received and held by the upper pair of spirals.

2. Apparatus as set forth in claim 1 wherein said element comprises an elongated spring.

3. Apparatus as set forth in claim 2 wherein said spring is of the constant tension recoil type, there being means carried by said mount supporting the spring thereon for windup about the mount and unwinding therefrom, the end of the spring free to unwind being secured to said feeder whereby oscillation of the latter effects unwinding of the spring and allows rewind thereof about the mount.

4. Apparatus as set forth in claim 3 wherein said mount includes a horizontal shaft adjacent the lower pair of spirals and a spool rotatably carried by the shaft and receiving the spring thereon in coiled configuration for free windup and unwinding therefrom, said shaft and the spool being located to permit unwinding of the spring along a path substantially coincident with the path of travel of said feed end of the web feeder.

* * * * *